US007441775B2

(12) United States Patent
Nally

(10) Patent No.: US 7,441,775 B2
(45) Date of Patent: Oct. 28, 2008

(54) GAME TABLE WITH CENTRIFUGAL BLOWER ASSEMBLY

(75) Inventor: Michael Nally, Ridgewood, NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 0 days.

(21) Appl. No.: 11/680,832

(22) Filed: Mar. 1, 2007

(65) Prior Publication Data

US 2008/0073839 A1 Mar. 27, 2008

Related U.S. Application Data

(60) Provisional application No. 60/846,317, filed on Sep. 21, 2006.

(51) Int. Cl.
*A63F 7/07* (2006.01)

(52) U.S. Cl. ..... 273/126 R; 273/126 A

(58) Field of Classification Search ..... 273/126 R, 273/126 A, 108.1

See application file for complete search history.

(56) References Cited

U.S. PATENT DOCUMENTS

| | | | | | |
|---|---|---|---|---|---|
| 2,048,911 | A | | 7/1936 | Zimmerman | |
| 3,415,478 | A | * | 12/1968 | Williams, III | 248/346.4 |
| 3,429,544 | A | * | 2/1969 | Williams | 239/557 |
| 3,641,782 | A | | 2/1972 | Timms | |
| 3,722,888 | A | | 3/1973 | Ducharme | |
| 3,773,325 | A | * | 11/1973 | Crossman et al. | 273/126 A |
| 3,871,585 | A | * | 3/1975 | Crossman et al. | 239/553.3 |
| 3,887,187 | A | * | 6/1975 | Crossman et al. | 273/126 A |
| 3,935,803 | A | | 2/1976 | Bush | |
| 3,954,267 | A | * | 5/1976 | Freeman et al. | 273/126 A |
| 3,987,581 | A | | 10/1976 | Brown | |
| 3,992,009 | A | | 11/1976 | Trbovich | |
| 4,017,078 | A | | 4/1977 | Goldfarb et al. | |
| 4,076,242 | A | * | 2/1978 | Joseph | 273/108.51 |
| 4,082,282 | A | * | 4/1978 | Trbovich | 273/126 R |
| 4,173,341 | A | | 11/1979 | Olliges | |
| 4,283,053 | A | | 8/1981 | Parker et al. | |
| 5,104,607 | A | | 4/1992 | Driska | |
| 5,356,143 | A | * | 10/1994 | Hylak | 273/126 A |
| 5,788,231 | A | | 8/1998 | To | |
| 6,003,866 | A | | 12/1999 | Tsai | |
| 6,109,607 | A | * | 8/2000 | Cartwright et al. | 273/108.1 |
| 6,152,451 | A | | 11/2000 | Bixby | |
| 6,419,224 | B1 | * | 7/2002 | Tsai | 273/108.1 |
| 6,454,260 | B1 | | 9/2002 | Noolandi et al. | |
| 2002/0066997 | A1 | * | 6/2002 | Noolandi et al. | 273/126 A |
| 2003/0168801 | A1 | * | 9/2003 | Zucchi et al. | 273/126 R |
| 2005/0281669 | A1 | | 12/2005 | Sohn et al. | |

OTHER PUBLICATIONS

U.S. Appl. No. 10/447,312, Not published, Nally et al.
Figure exemplifying an air table previously marketed by Applicant.

* cited by examiner

*Primary Examiner*—Raleigh W. Chiu
(74) *Attorney, Agent, or Firm*—Fellers, Snider, Blankenship, Bailey & Tippens

(57) ABSTRACT

A game table is disclosed. The table includes a flat game surface having a plurality of air holes defined therein and a plenum box having a tapered profile proceeding from a shorter end to a taller end. There may be a plurality of elongate passageways between the plenum box and the flat playing surface, the passageways being arranged longitudinally with respect to the flat game surface and laterally with respect to the plenum box.

20 Claims, 7 Drawing Sheets

GAME TABLE WITH CENTRIFUGAL BLOWER ASSEMBLY

CROSS REFERENCE TO RELATED APPLICATIONS

This application claims priority to U.S. Patent Application Ser. No. 60/846,317, filed Sep. 21, 2006, which is herein incorporated by reference.

BACKGROUND OF THE INVENTION

1. Field of the Invention

This invention relates generally to air cushion table games, and more particularly to an air powered hockey game table.

2. Background

Typically, an air cushion game table includes a playing surface that is perforated to permit jets of air to pass through the playing surface for providing an air bed to facilitate low friction movement of a game piece, such as a puck, across an upper surface of the playing surface. Pressurized air is supplied from below the playing surface, which creates a multiplicity of closely spaced air jets emanating from the perforations in the playing surface. The table is bounded by side walls and end walls, which provide rebounding surfaces for the puck. Each player is provide with a pusher, which the player can slide across the table surface and into contact with the puck. An automatic scoring system is sometimes provided to record the deliver of the pucks into a goal.

One drawback associated with known air cushion table games is a lack of uniformity in distribution of air to the perforations. Air jets passing through perforations in the center of the table typically deliver greater flow than air jets located proximate the sidewalls surrounding the game surface. As a result, uniform play is comprised. In addition, in some cases, increasing the air flow can also increase the amount of turbulence in the air plenum box. Furthermore, some air delivery systems are too large and present an unacceptable obstruction beneath game table.

Therefore what is needed is a system and method for addressing the above, and related, issues.

SUMMARY OF THE INVENTION

The present invention as disclosed and claimed herein, in one aspect thereof, comprises a game table. The table includes a flat game surface having a plurality of air holes defined therein and a plenum box having a tapered profile proceeding from a shorter end to a taller end. There may be a plurality of elongate passageways between the plenum box and the flat playing surface, the passageways being arranged longitudinally with respect to the flat game surface and laterally with respect to the plenum box.

In one embodiment, the air holes are sized to permit airflow therethrough to provide air cushioning of a game puck. The plenum box conveys air under positive pressure into the plurality of longitudinal air passage ways. The plenum box comprises first and second end walls, two side surfaces, and a bottom surface, the two end walls being of first and second height, respectively, wherein the second height is greater than the first height. At least one of the two side surfaces has a side wall opening proximate the second end wall and sized to receive output from a blower.

In some embodiments, the flat game surface or playing surface is marked and sized to approximate a scaled-down hockey arena. The table may include side walls, end walls, and corner members bounding the flat playing surface. The plenum box may also have an internal diverter. In one embodiment the blower is configured to provide air into the plenum box under positive pressure.

BRIEF DESCRIPTION OF THE DRAWINGS

The present invention is illustrated by way of example and is not limited by the figures of the accompanying drawings, in which like reference numbers indicate similar parts. Moreover, the drawings are not necessarily to scale and features may have been enlarged or reduced to show detail.

DETAILED DESCRIPTION

Figure 1:
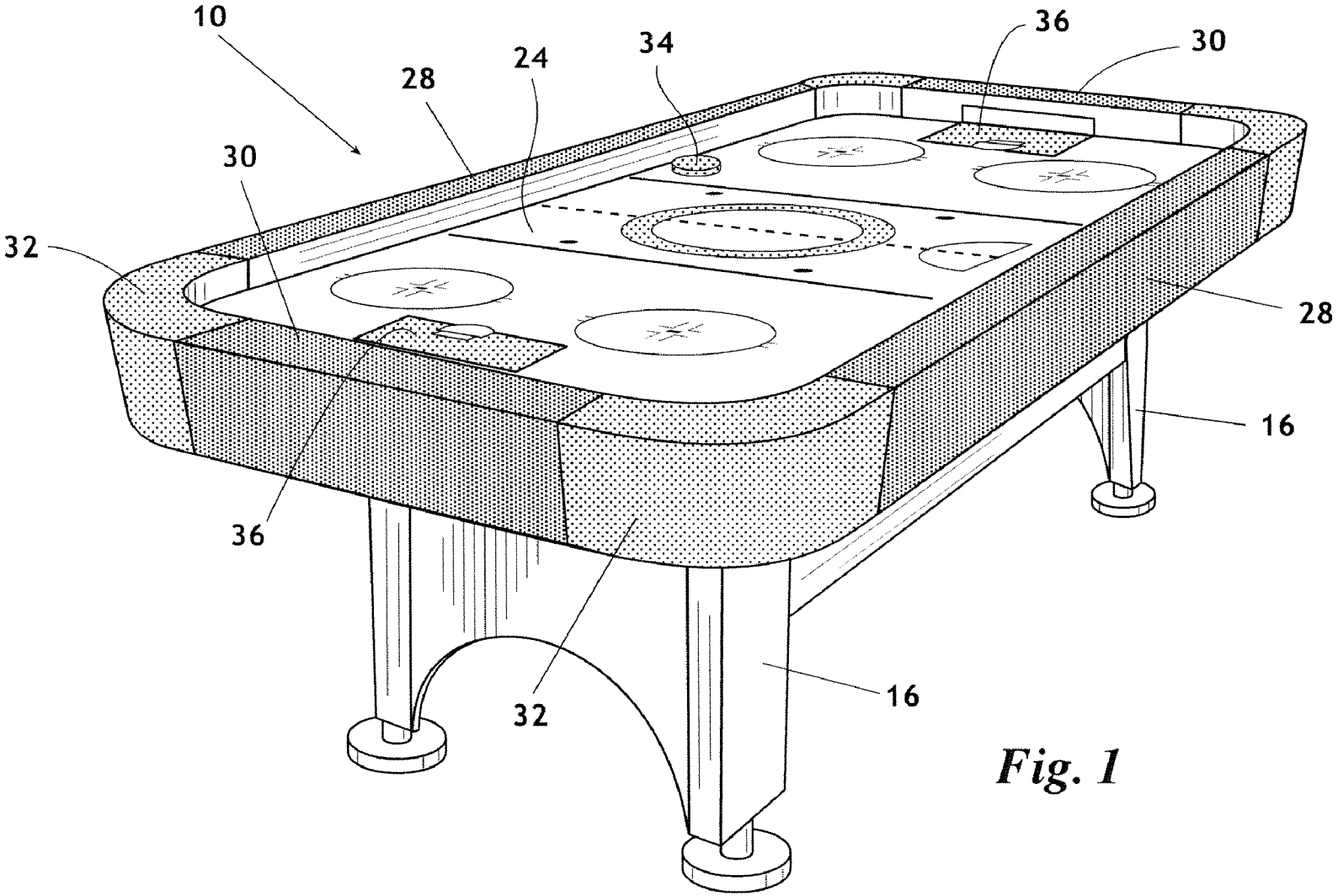
FIG. 1 is a perspective view of one embodiment 10 of an air cushion game table according to aspects of the present disclosure.

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Referring now to the accompanying figures, there is shown an air cushion game table 10. Air cushion game table 10 includes a bottom panel 12 that defines a central passageway 14. Four support legs 16 communicate with the bottom panel 12 for supporting the game table 10. A plurality of cross members 18 are located on an upper surface of the bottom panel 12. Cross members 18 support intermediate member 19.

A plurality of longitudinal support members 20 are supported by an upper surface of the intermediate member 19. An underside of the intermediate member 19 and a top surface of bottom panel 12 define plenum chamber 21. Air flow passes from plenum chamber 21 through passageways 23 and into longitudinal air channels 22. Longitudinal support members 20 define longitudinal air channels 22 between adjacent longitudinal support members 20.

A game surface 24 has a plurality of small openings 26 formed therein for allowing jets of air to flow through the game surface 24. The air jets provide an air cushion on an upper side of the game surface 24. The small openings 26 are located above the longitudinal air channels 22.

Game surface 24 is surrounded by side walls 28, end walls 30, and corner members 32 for containing a puck 34 on the upper surface of game surface 24. Goals 36 are located proximate each end wall 30 for receiving the puck 34. Goals 36 may be integral with end wall 30 or may be formed on the game surface 24. A puck return tray 38 is located on an underside of the bottom panel 12 for delivering the puck 34 to a player after the puck 34 is delivered to a goal 36 by an opposing player. It can be seen that the game surface 24 is substantially square or rectilinear in shape. The game surface 24 may be rounded at the corners to approximate the shape of a hockey arena.

A plenum box 50 is mounted laterally on an underside of said bottom panel 12. The plenum box 50 includes a bottom surface 52, and a first end wall 54 at a first end 56 of the plenum box 50. Additionally, the plenum box 50 includes a second end wall 58 at a second end 60 of the plenum box 50. The plenum box 50 further includes side surfaces 62. The bottom surface 52 is a sloping panel that communicates with side surfaces 62, the first end wall 54, and the second end wall 58.

A side-mounted centrifugal air blower 59 is attached to the underside of the bottom panel 12 using wood screws through mounting holes 61 or using other attachments and/or adhesives. The centrifugal air blower 59 comprises: a blower housing 63 having a bottom air inlet 65; an internal centrifugal fan 67 which receives air from the bottom inlet 65 and blows the air horizontally outward in the housing 63; a housing discharge outlet 69 which blows air horizontally through a mating side wall opening 71, possibly provided in a side wall 62 of the lateral plenum box 59 near an end thereof; an electrical power cord and plug 72; an electrical switch box 74; and an on/off switch 76. The circuitry shown and described herein represents only one possible control scheme for the blower 59. The circuitry could be adapted to power additional blowers or other components for example.

Although the use of a single blower 59 is shown the drawings, a plurality of blowers 59 could alternatively be used. In addition, the blower or blowers 59 could alternatively be mounted at the other locations different from the location shown in the drawings. The blower 59 has been shown and described as a centrifugal type blower—also known as a "squirrel cage" blower. However, other type of blowers such as impeller driven or axial blowers could also be used.

Figure 2:
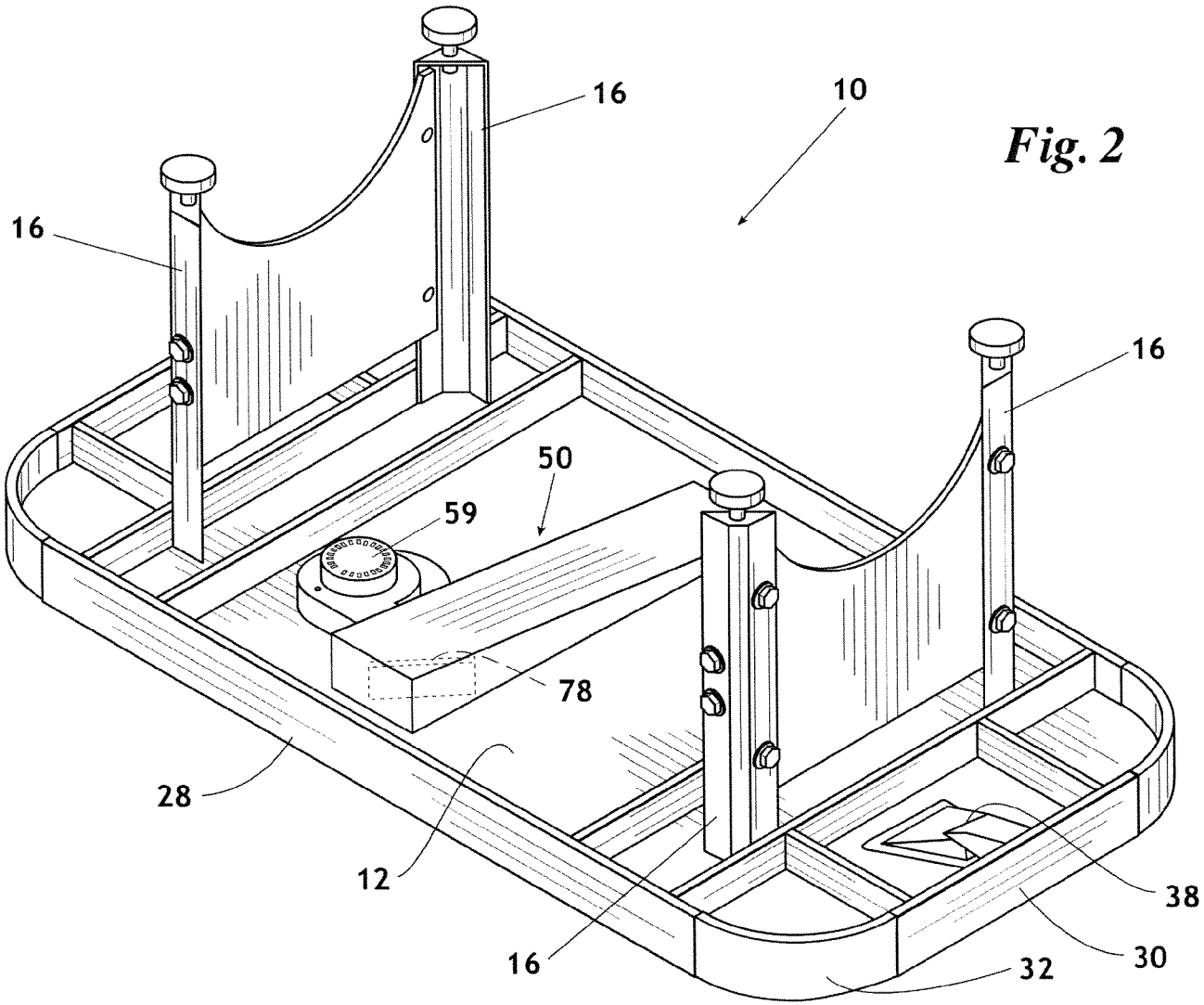
FIG. 2 is a perspective view of an underside of the air cushion game table 10 of FIG. 1.
Figure 3:
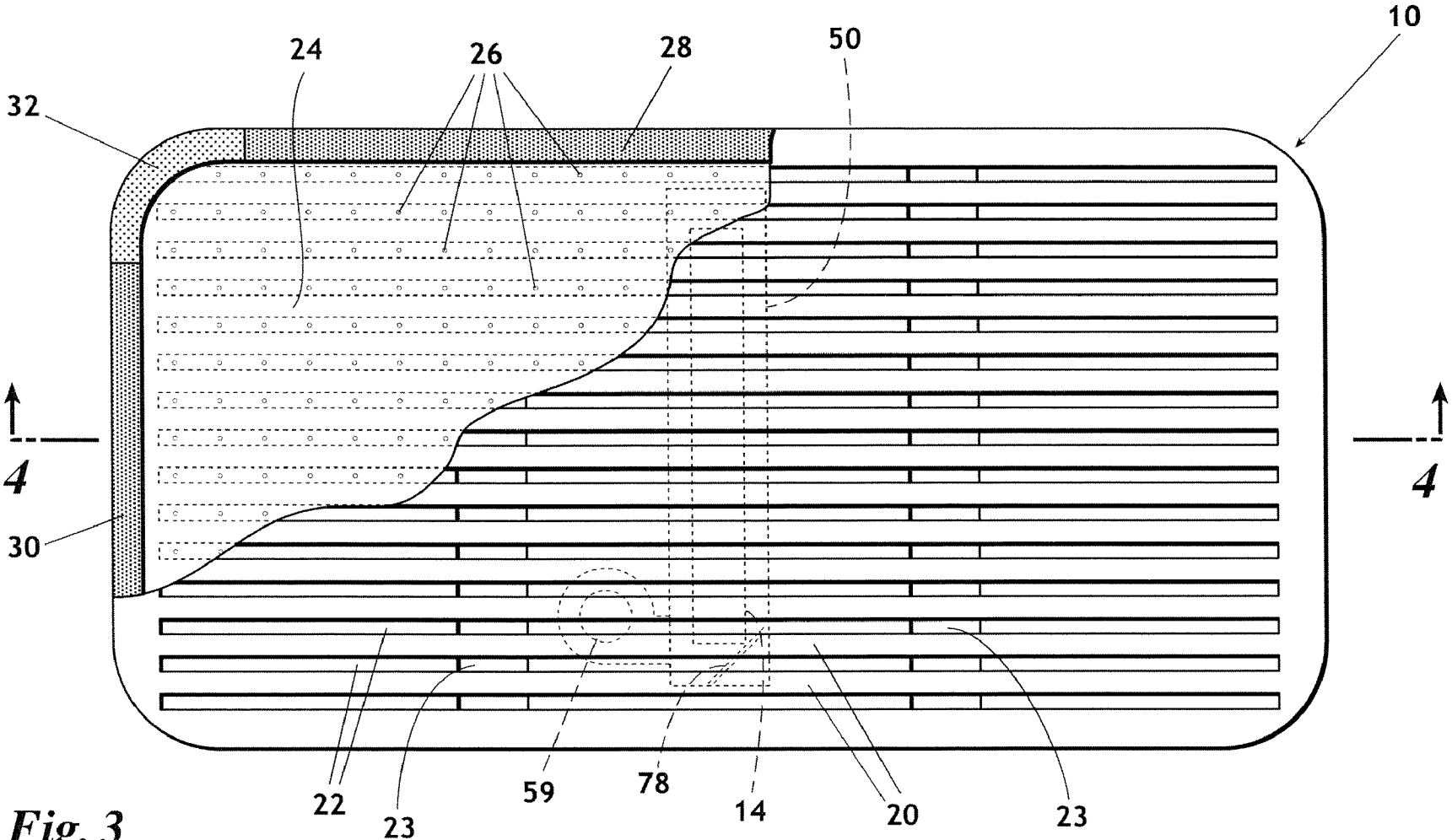
FIG. 3 is a top view of the air cushion game table 10 of FIG. 1, showing a partial cut-away view of the game surface.
Figure 4:
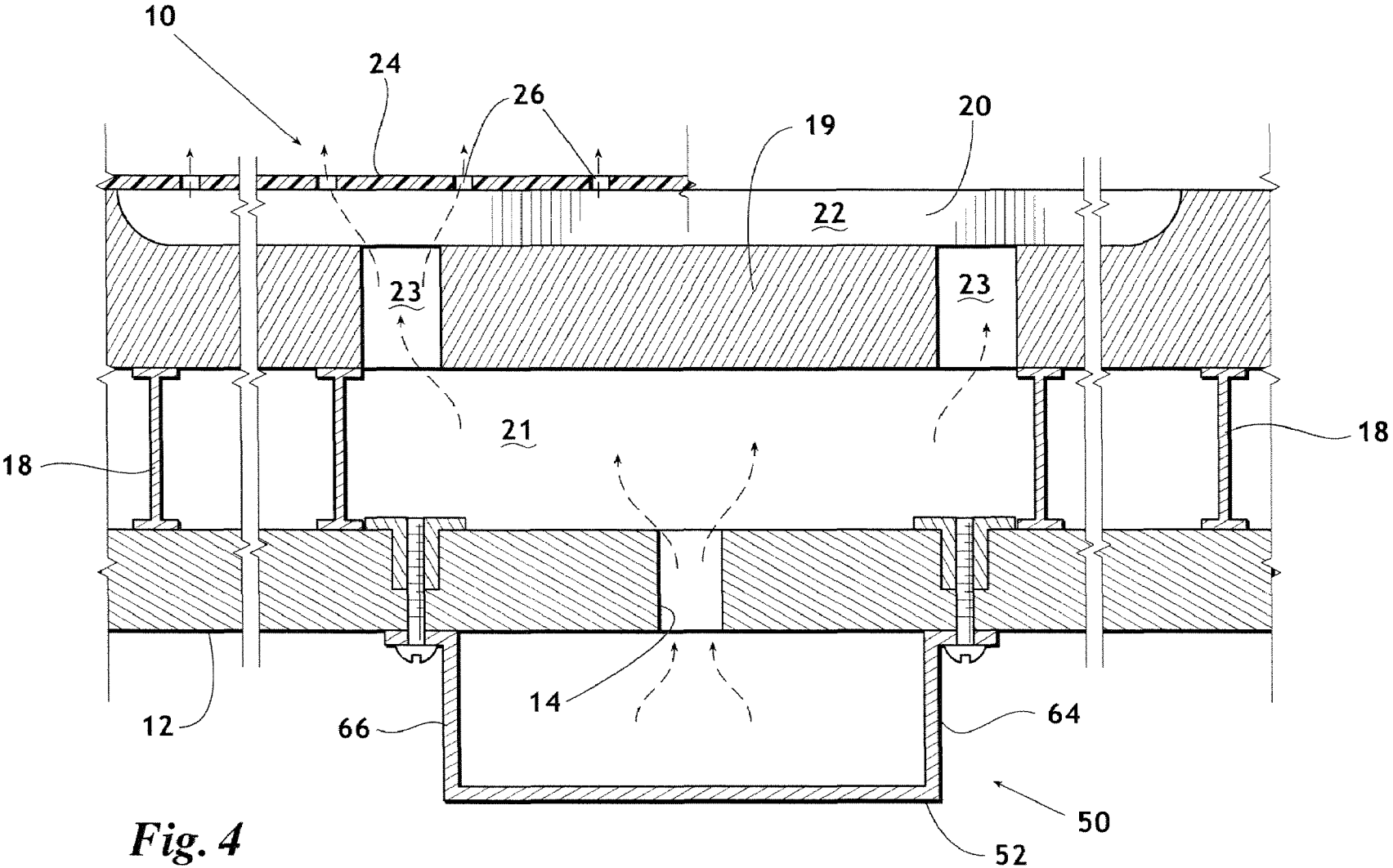
FIG. 4 is a cross-sectional view of the game table 10 of FIG. 1, taken along line 4-4 of FIG. 3.
Figure 6:
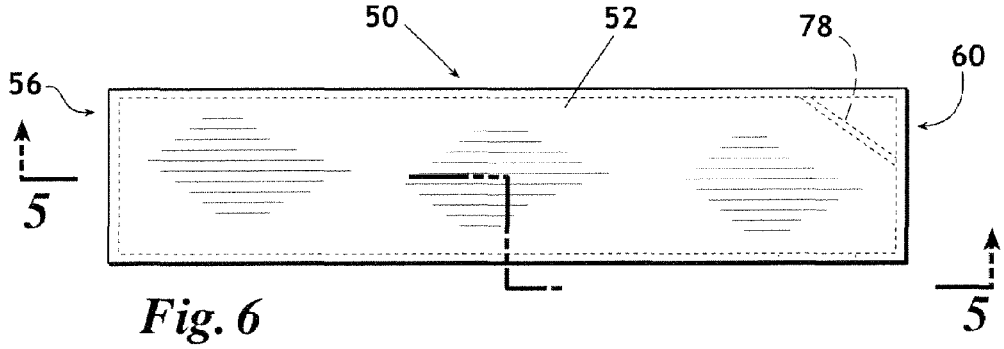
FIG. 6 is a plan view of an underside of the plenum box 50.
Figure 5:
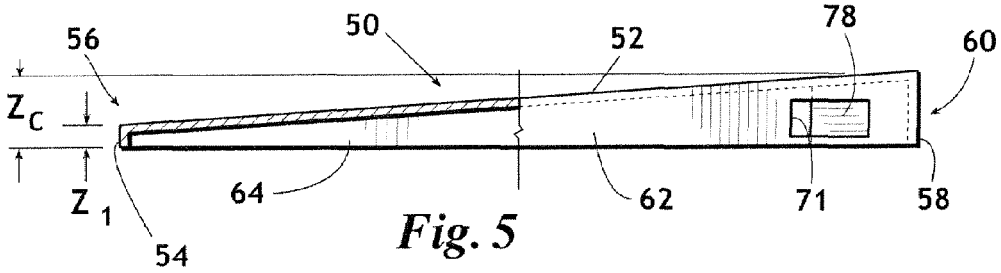
FIG. 5 is a side view of a tapered plenum box 50 for use with an air cushion game table according to aspects of the present disclosure.
Figure 8:
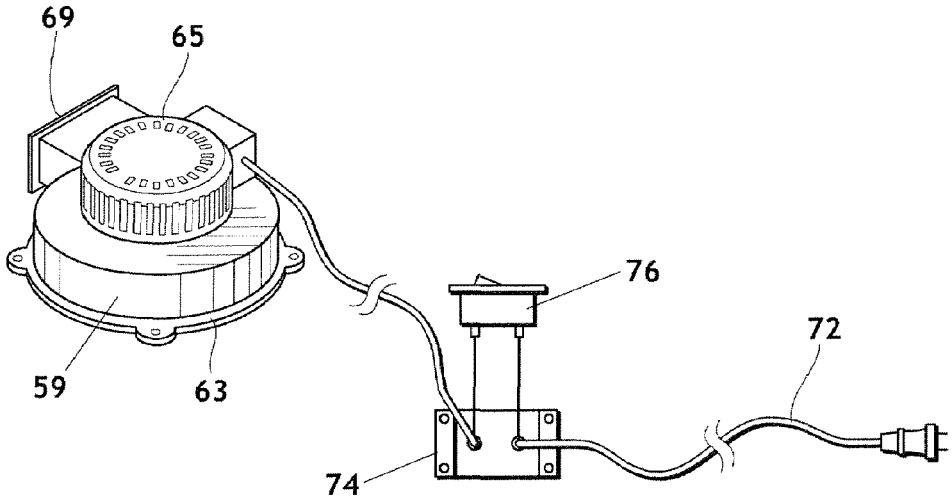
FIG. 8 schematically illustrates a centrifugal air blower 59 employed in an air cushion table according to aspects of the present disclosure.
Figure 7:
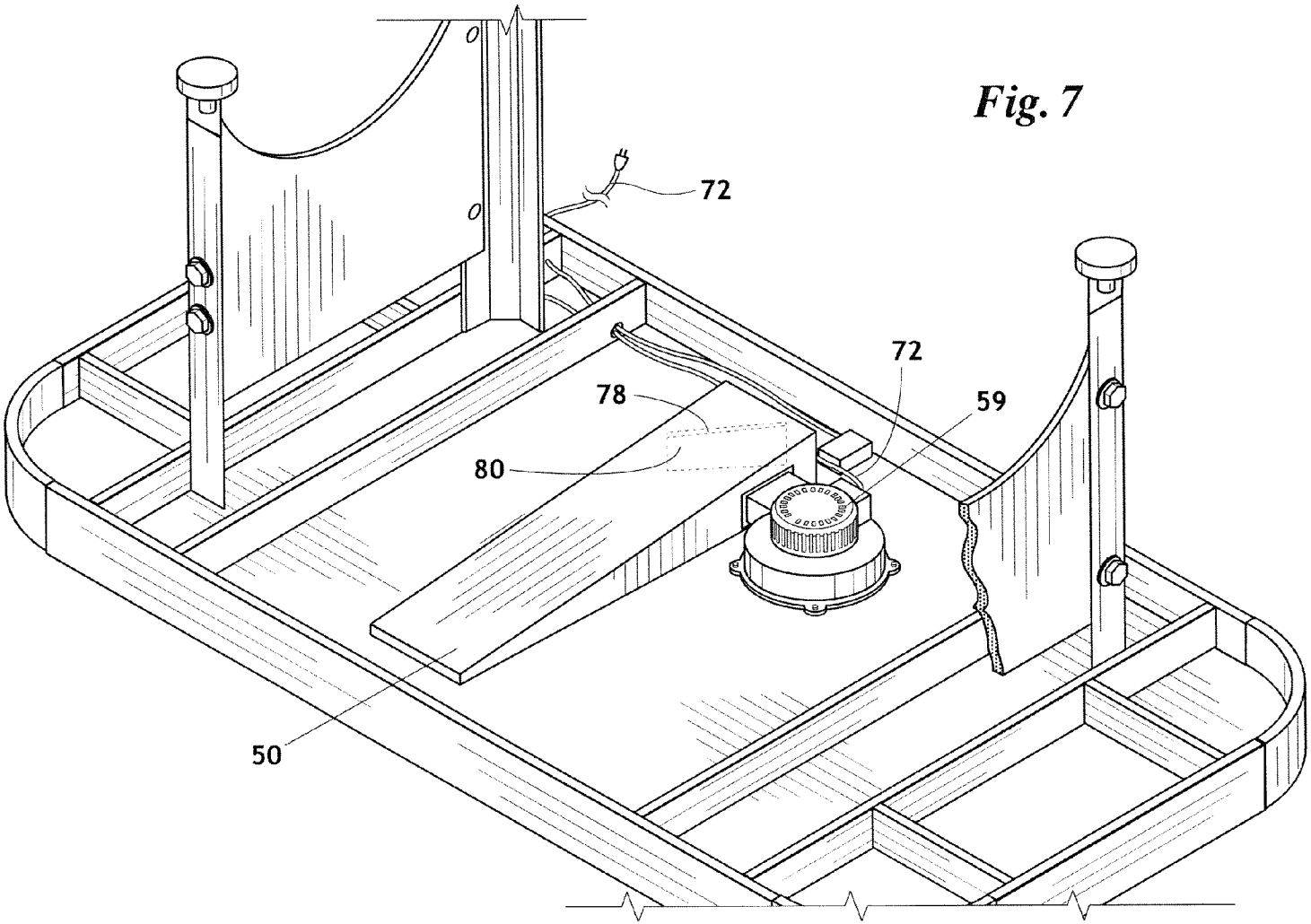
FIG. 7 is a bottom view of an air cushion table employing a plenum box of uniform depth according to aspects of the present disclosure.
Figure 9:
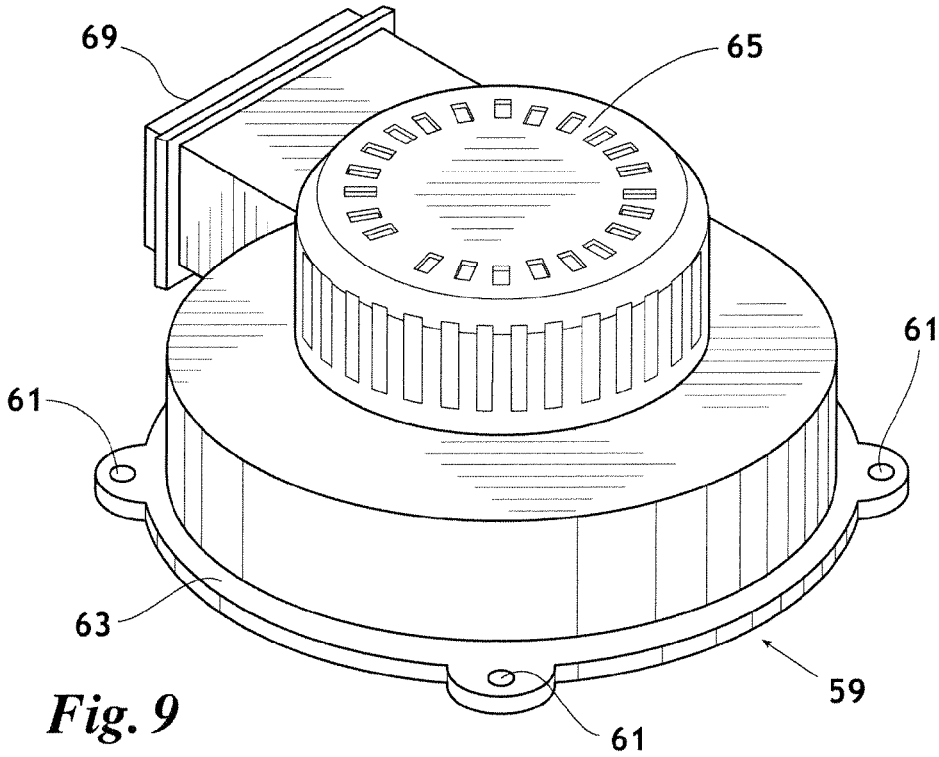
FIG. 9 is a lower view of the centrifugal air blower 59.
Figure 10:
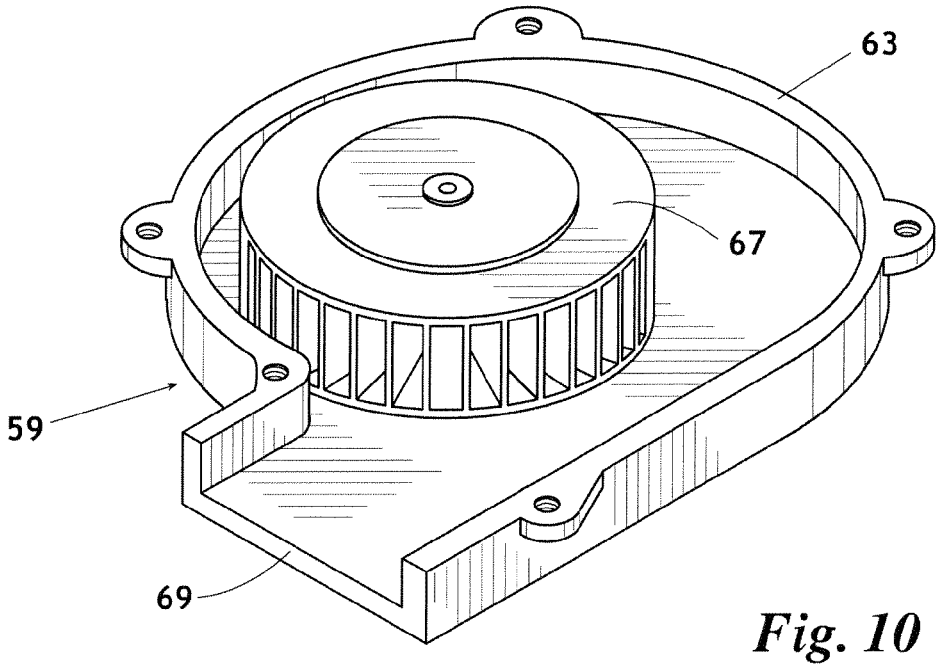
FIG. 10 is an upper view of the centrifugal air blower 59.

The plenum box 50 can be of uniform depth as illustrated in FIG. 7 but will preferably be a tapered plenum box of the type shown on FIGS. 2, 5, and 6. A diverter 78 may be positioned within the plenum box for deflecting the horizontal air flow from the blower outlet 69 and distributing the air throughout the remainder of the plenum box 50. The diverter 78 may be a diverter panel or other structure providing an air deflecting surface 80 which is angled across an interior cover of the plenum box 50.

Referring to the tapered plenum box 50 illustrated in FIGS. 2, 5, and 6, a depth $z_c$ of the plenum box 50 is greater at the second end 60, than the depth $z_1$ at the first end 56. The greater depth $z_c$ at the second end 60 of the plenum box 50 as compared to the depth $z_1$ at first end 56 results in an increased and more uniform air flow into the plenum chamber 21 in areas of the table proximate the side walls 28. As a result, an increased flow of air passes through openings 26 in game surface 24 that are closer to the sidewalls 28—particularly those near the first end 56 of the plenum box 50. Therefore, air flow emitted through the openings 26 across a width of the game surface 24 is evened out, which enhances game play.

As air is blown horizontally into the plenum box 50, air flow is dispersed by the diverter 78 across the width of the game table 10. Plenum box 50 communicates with plenum area 21 through passageway 14 formed in bottom panel 12. As a result, air flow passes from the plenum box 50 to the plenum area 21. Air flow then passes through passageways 23 formed in the intermediate member 19 and into longitudinal air channels 22 formed between adjacent longitudinal support members 20. The air then escapes from the longitudinal air channels 22 through a plurality of small openings 26 formed in the game surface 24.

The plenum box 50 is tapered such that the plenum box 50 has a greater depth $z_c$ at the first end 56 than at the second end 60. By tapering plenum box 50, the air flow is increased towards the first end 56 of the plenum box 50. As a result, increased air flow is experienced through small openings 26 on the game surface 24 that are proximate the sidewalls 28. By providing a tapered plenum box 50, difficulties with reduced air flow through small openings 26 near the sidewalls 28 is eliminated.

It will be appreciated that the system described above, in some embodiments, provides increased air flow through the orifices 26 in the game table surface 24. In some embodiments, air is forced through the orifices 26 in the air cushion game table playing surface 24 by first delivering air to the plenum box 50 using a centrifugal blower delivery system. The centrifugal blower system preferably comprises a side-mounted centrifugal blower which delivers air horizontally into a side of the plenum box. In addition, a deflector 78 may be provided in the plenum box for distributing the horizontal air flow evenly throughout the plenum box 50. The side-mounted centrifugal blower 59 and internal deflector 78 operate to significantly reduce turbulence within the plenum box 50 as compared to the traditional fan systems used heretofore which blow air vertically upward into the box. The side-mounted centrifugal blower system is also significantly more compact that the traditional vertical fan system which extends downwardly from the bottom of the plenum box 50.

In some embodiments, air is dispersed from the plenum box 50 into the plenum chamber 21 for subsequent delivery through the playing surface orifices 26. The flow of the air from the plenum box 50 is relatively constant along a longitudinal axis of the plenum box 50. Therefore, air is delivered into the plenum chamber 21, and in turn the longitudinal air channels 22, in a uniform manner rather than in a center-biased unequal distribution seen in known designs.

The plenum box 50, blower 59, and related components have been shown in use with exemplary of game tables having series of passageways and longitudinal air channels to further direct and control the flow of air. However, this is for illustrative purposed only. The plenum box 50 and blower 59 could also be used with any game table or device requiring substantially constant air pressure and/or volume of airflow across the length of the plenum box 50.

Thus, the present invention is well adapted to carry out the objects and attain the ends and advantages mentioned above as well as those inherent therein. While exemplary embodiments have been described for purposes of this disclosure, numerous changes and modifications will be apparent to those of ordinary skill in the art.

What is claimed is:

1. A game table comprising:

a flat game surface having a plurality of air holes defined therein; and a plenum box having a tapered profile proceeding from a shorter end to a taller end, an air intake proximate the taller end, and an internal diverter configured to at least partially redirect airflow from the taller end to the shorter end;

wherein the plenum box communicates with the flat game surface to provide substantially equal air flow through the plurality of air holes.

2. The game table of claim 1, further comprising a plurality of elongate passageways interposing the plenum box and the flat game surface, the passageways being arranged longitudinally with respect to the flat game surface and laterally with respect to the plenum box.

3. The game table of claim 2, wherein the holes defined in the flat game surface are arranged in rows, each row in communication with one of the plurality of elongate passageways.

4. The game table of claim 2, further comprising a plenum chamber interposing the longitudinal passageways and the plenum box for communicating moving air from the plenum box into the longitudinal passageways.

5. The game table of claim 1, further comprising a blower attached to the air intake proximate the taller end and configured to provide positive air pressure into the plenum box.

6. The game table of claim 5, wherein the blower is a centrifugal type blower.

7. The game table of claim 1 wherein the flat game surface is substantially rectilinear in shape.

8. The game table of claim 1, wherein the flat game surface is marked to simulate a hockey arena.

9. The game table of claim 1, further comprising a plurality of legs configured to stabilize the flat game surface in a substantially horizontal position.

10. An air powered hockey table comprising:

a flat playing surface defining a plurality of substantially evenly spaced holes therein sized to permit airflow therethrough to provide air cushioning of a game puck;

a plurality of longitudinal air passage ways connecting to the flat playing surface on a bottom side and arranged to convey air to the air holes; and a plenum box arranged laterally across the longitudinal air passage ways and configured to convey air under positive pressure into the plurality of longitudinal air passage ways;

wherein the plenum box comprises first and second end walls, two side surfaces, and a bottom surface, the two end walls being of first and second height, respectively, wherein the second height is greater than the first height; and wherein at least one of the two side surfaces has a side wall opening proximate the second end wall and sized to receive output from a blower.

11. The air powered hockey table of claim 10, wherein the plenum box further comprises a diverter positioned near the side wall opening to divert incoming airflow along a length of the plenum box.

12. The air powered hockey table of claim 10, further comprising a centrifugal blower attached to the side wall opening and configured to provide airflow into the plenum box.

13. The air powered hockey table of claim 12, further comprising a power circuit for selectively powering the blower.

14. The air powered hockey table of claim 10, wherein the flat playing surface is marked and sized to approximate a scaled-down hockey arena.

15. The air powered hockey table of claim 10, further comprising side walls, end walls, and corner members bounding the flat playing surface.

16. The air powered hockey table of claim 15, further comprising a puck return tray in each of the end walls.

17. The air powered hockey table of claim 10, further comprising a plurality of legs adapted to support the flat playing surface in a substantially horizontal position.

18. An air powered hockey table comprising:

a flat playing surface defining a plurality of substantially evenly spaced holes therein sized to permit airflow therethrough to provide air cushioning of a game puck, the flat playing surface being marked and sized to approximate a scaled-down hockey arena;

side walls, end walls, and corner members bounding the flat playing surface;

a plurality of longitudinal air passage ways connecting to the flat playing surface on a bottom side and arranged to convey air to the air holes;

a plenum box arranged laterally across the longitudinal air passage ways and configured to convey air under positive pressure into the plurality of longitudinal air passage ways; and a blower;

wherein the plenum box comprises first and second end walls, two side surfaces, a bottom surface, and an internal diverter, the two end walls being of first and second height, respectively, wherein the second height is greater than the first height;

wherein at least one of the two side surfaces has a side wall opening proximate the second end wall and sized to receive output from the blower; and wherein the blower is configured to provide air into the plenum box under positive pressure.

19. The air powered hockey table of claim 18, wherein the blower is a centrifugal blower.

20. The air powered hockey table of claim 18, wherein the blower is selectively powerable.

* * * * *